United States Patent [19]

Fletcher et al.

[11] Patent Number: 4,724,904

[45] Date of Patent: Feb. 16, 1988

[54] NUCLEAR STEAM GENERATOR TUBE ORIFICE FOR PRIMARY TEMPERATURE REDUCTION

[75] Inventors: Wilson D. Fletcher, Pleasant Hills Boro; Earl H. Novendstern, Churchill Boro, both of Pa.

[73] Assignee: Westinghouse Electric Corp., Pittsburgh, Pa.

[21] Appl. No.: 674,455

[22] Filed: Nov. 23, 1984

[51] Int. Cl.[4] ..... F28F 9/02

[52] U.S. Cl. ..... 165/174; 376/402

[58] Field of Search ..... 165/174; 376/402

[56] References Cited

U.S. PATENT DOCUMENTS

| | | | |
|---|---|---|---|
| 2,806,718 | 9/1957 | Cook et al. | 165/174 X |
| 4,199,537 | 4/1980 | Zardi et al. | 165/174 X |
| 4,230,527 | 10/1980 | Cella | 376/402 |
| 4,300,481 | 11/1981 | Fisk | 122/406 B |
| 4,314,587 | 2/1982 | Hackett | 165/177 |
| 4,334,554 | 6/1982 | Geiger et al. | 138/44 |

FOREIGN PATENT DOCUMENTS

| | | | |
|---|---|---|---|
| 26037 | 7/1923 | France | 165/174 |
| 1030245 | 5/1966 | United Kingdom | 165/174 |
| 1192212 | 5/1970 | United Kingdom | 165/174 |
| 1344812 | 1/1974 | United Kingdom | 165/174 |
| 1507833 | 4/1978 | United Kingdom | 165/174 |

*Primary Examiner*—Albert W. Davis, Jr.
*Assistant Examiner*—Peggy Neils

[57] ABSTRACT

An orifice insert for placement in nuclear steam generator tubes comprises a sleeve having a top end, a bottom end located in use in the vicinity of the opening of the steam generator tube, and a longitudinal axis. An orifice is disposed in and extends the entire length of the sleeve. At least a portion of the outer diameter of the sleeve is substantially the same as the inner diameter of the steam generator tube. The orifice comprises at least a lower and an upper cylindrical portion which are coaxial with the longitudinal axis of the sleeve, wherein the diameter of the upper cylindrical portion is smaller than the diameter of the lower cylindrical portion.

5 Claims, 15 Drawing Figures

FIG. 3A.
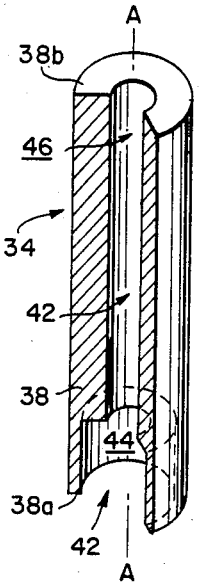
FIG. 4A.
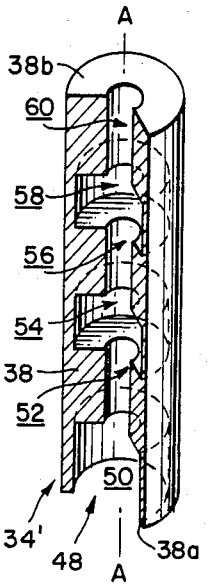
FIG. 5A.
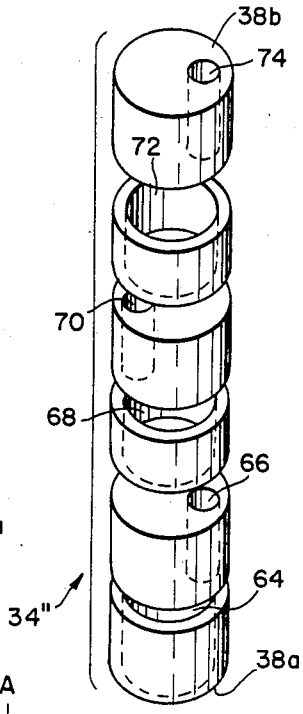
FIG. 5B.
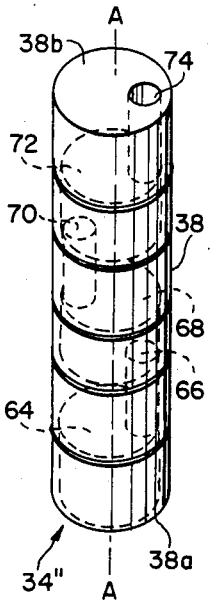
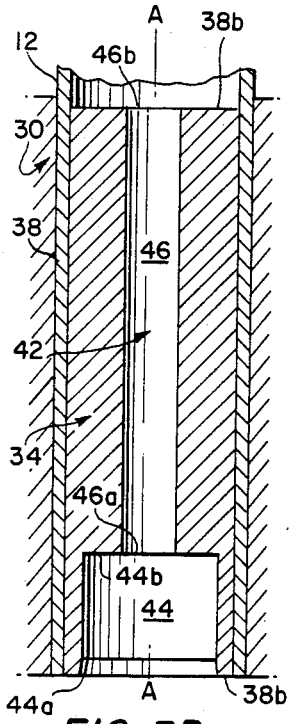
FIG. 3B.
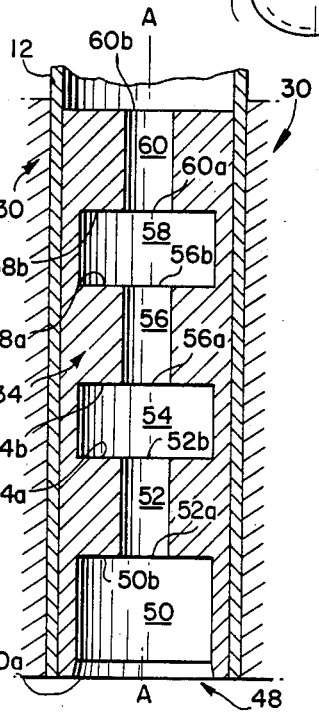
FIG. 4B.
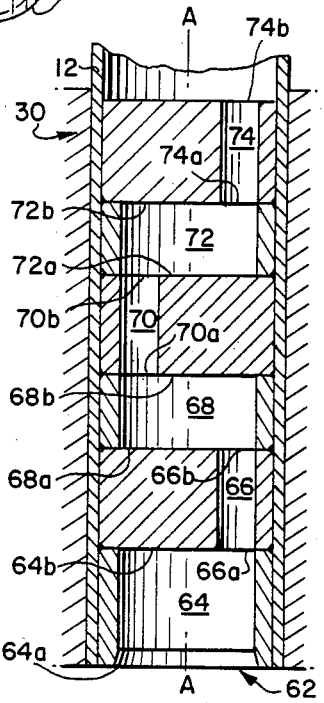
FIG. 5C.

NUCLEAR STEAM GENERATOR TUBE ORIFICE FOR PRIMARY TEMPERATURE REDUCTION

BACKGROUND OF THE INVENTION

1.Field of the Invention

The invention relates in general to the maintenance of nuclear steam generator tubes, and more specifically to an orifice insert for placement into nuclear steam generator tubes for primary temperature reduction.

2. Description of the Prior Art

A nuclear steam generator 10 of the type found in the art is shown in FIG. 1 of the attached drawings as comprising an array of a large number of vertically oriented U-shaped tubes 12. The tubes 12 are disposed in a cylindrical portion 14 ot the steam generator 10 whose bottom end is associated with a radiation confining housing or channel head 16, typically having a bottom portion or bowl 18 of a hemispherical configuration. The channel head 16 is divided by a divider plate 20 into a first half 22 typically known as the hot leg plenum, and a second half 24 typically known as the cold leg plenum. An inlet pipe (not shown) supplies hot water to the hot leg plenum 22, while a return pipe 26 is coupled to the cold leg plenum 24. The hot water entering the hot leg plenum 22 passes into the exposed openings of the plurality of U-shaped tubes 12, then through tubes 12 to be introduced into the cold leg plenum 24. A circular tube sheet 28 is disposed at the bottom of cylindrical portion 14. Tube sheet 28 is divided into a first semi-circularly shaped half 30 and a second semi-circularly-shaped half 32 by divider plate 20. As shown in FIG. 1, the water entry openings of the tubes 12 are supported within openings in first tube sheet half 30, while the water exit openings of the tubes 12 are supported within openings in second tube sheet half 32.

Corrosion of the U-shaped tubes 12 is a concern in certain steam generators. Corrosion is usually the result of chemical attack and can occur on the outside surface, which is exposed to boiler steam and on the inside surface, which is exposed to water. Water chemistry treatment has been used in the past to protect the U-shaped tubes 12, as well as other system components, from corrosion. However, chemical treatment will not be successful unless all factors contributing to corrosion are detected and appreciated. Once corrosion has occurred, maintenance of the tubes 12 is typically effected by removing from service a defective tube by "plugging" each end. "Plugging" is carried out by entering a first portion of the channel head 16 to seal first one end of a defective tube 12 and then entering the second portion of the channel head 12 to seal the other end of the tube 12. This procedure is complicated and time consuming.

SUMMARY OF THE INVENTION

Briefly, the present invention is a new orifice insert for insertion into the openings of the water tubes which permits achieving a target temperature required to minimize corrosion or cracking while maintaining the maximum possible heat load for the steam tube. The orifice insert comprises a sleeve having a top end, a bottom end located in use in the vicinity of the opening of the steam generator tube, and a longitudinal axis. An orifice is disposed in and extends the entire length of the sleeve. At least a portion of the outer diameter of the sleeve is substantially the same as the inner diameter of the steam generator tube.

In one aspect of the invention, the orifice comprises a lower and an upper cylindrical portion which are coaxial with the longitudinal axis of the sleeve, wherein the diameter of the upper cylindrical portion is smaller than the diameter of the lower cylindrical portion.

In another aspect of the invention, the orifice comprises a lower cylindrical portion, first, second, third, and fourth intermediate cylindrical portions, and an upper cylindrical portion, wherein the diameter of the lower cylindrical portion is greater than the diameter of the upper cylindrical portion, the diameters of the second and fourth intermediate cylindrical portions are equal to the diameter of the lower cylindrical portion, and the diameters of the first and third intermediate cylindrical portions are equal to the diameter of the upper cylindrical portion. The lower cylindrical portion and the second and fourth intermediate cylindrical portions are coaxial with the longitudinal axis of the sleeve. The upper cylindrical portion and the first and third intermediate cylindrical portions can also be coaxial with the longitudinal axis of the sleeve, or they can be staggered, with the axes of the first and third intermediate cylindrical portions being disposed at diametrically opposed locations with respect to the lower cylindrical portion, and the upper cylindrical portion being coaxial with the first intermediate cylindrical portion.

BRIEF DESCRIPTION OF THE DRAWINGS

The invention may be better understood, and further advantages and uses thereof are readily apparent, when considered in view of the following detailed description of explanatory embodiments, taken with the accompanying drawings, in which:

FIG. 3*a* is a partially cut-away perspective view of a first embodiment of an orifice insert according to the invention;

FIG. 3*b* is a cross-sectional view of the orifice insert shown in FIG. 3*a*, taken along line 3*b*—3*b*, installed in a steam generator tube;

FIG. 4*a* is a partially cut-away, perspective view of a second embodiment of an orifice insert according to the invention;

FIG. 4*b* is a cross-sectional view of the orifice insert shown in FIG. 4*a*, taken along line 4*b*—4*b*, installed in a steam generator tube;

FIG. 5*a* is a blown-apart perspective view of a third embodiment of an orifice insert according to the invention;

FIG. 5*b* is an assembled perspective view of the orifice insert shown in FIG. 5*a;*

FIG. 5*c* is a cross-sectional view of the orifice insert shown in FIG. 5*b*, taken along line 5*c*—5*c;*

DESCRIPTION OF THE PREFERRED EMBODIMENTS

Figure 1:
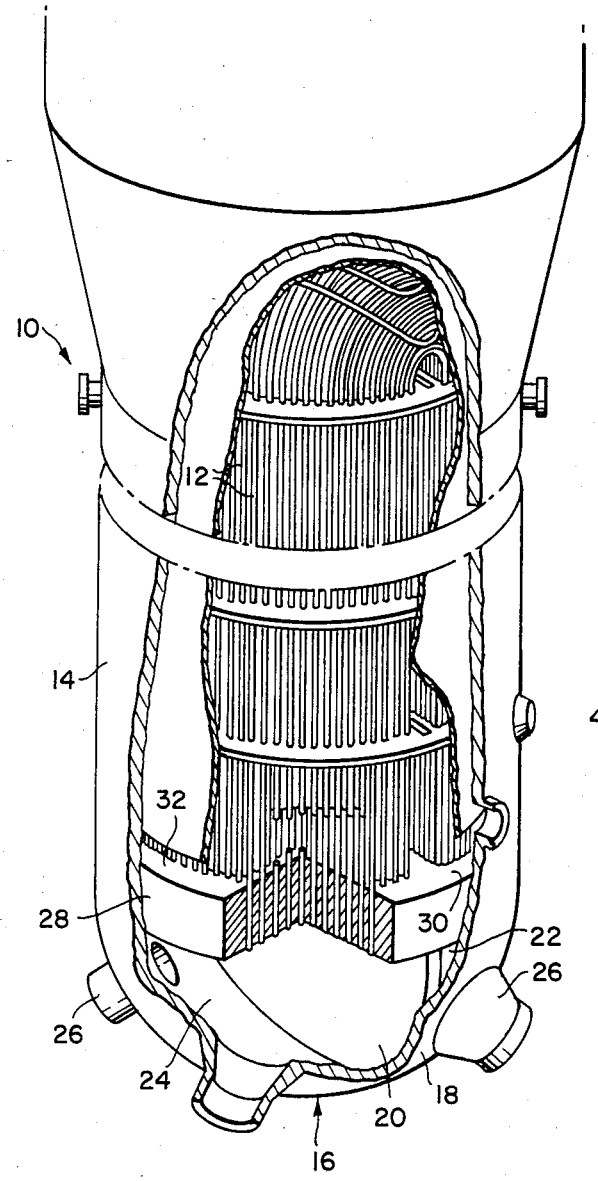
FIG. 1 is a cut-away perspective view of a nuclear steam generator.
Figure 2:
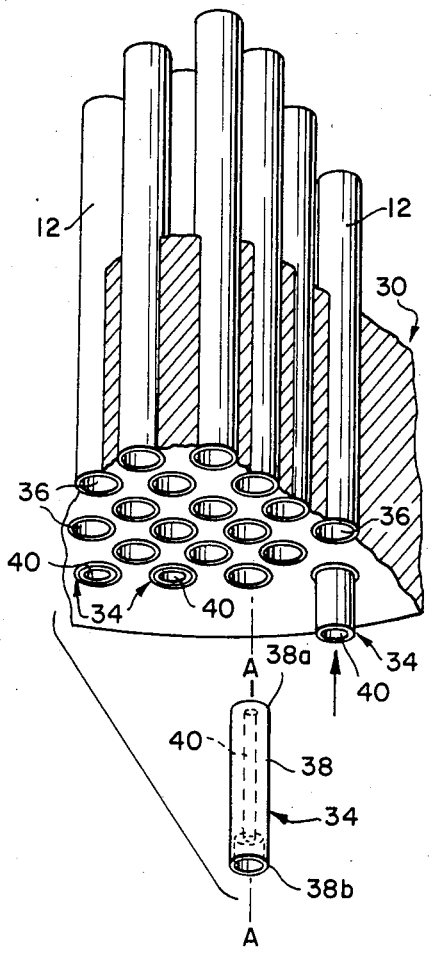
FIG. 2 is a perspective, partially blown-apart view showing the position of orifice inserts according to the invention with respect to the steam entry openings of the steam generator tubes of the nuclear steam generator of FIG. 1.

Referring now to FIG. 2, there are illustrated a number of orifice inserts 34 according to the invention which are adapted for affixation in tube 12 by welding or similar means. Orifice inserts 34 are inserted into the steam entry openings 36 of steam generator tubes 12. In general, each orifice insert 34 comprises a cylindrical sleeve 38 whose outer diameter is substantially the same as the inner diameter of steam generator tubes 12, to permit a tight fit. Orifice inserts 34 can be permanently affixed within tubes 12 by any conventional means, such as by welding, or as will be described in greater detail hereinafter, by mechanical expansion. They can also be temporarily affixed within tubes 12 by any conventional means.

It should be understood that all directional designations such as top, bottom, upper, lower, and longitudinal are made with reference to the orientation of an orifice insert which has been inserted in a steam generator tube.

Each cylindrical sleeve has a bottom end 38*a*, a top end 38*b*, and a longitudinal axis A. Top end 38*b* is inserted into a tube 12 so that bottom end 38*a* is located in the vicinity of the opening of the tube 12. An orifice 40, whose shape can vary, extends the entire length of orifice insert 34. Orifice inserts 34 thus effectively reduce the inner diameter of steam generator tubes 12, thereby reducing the primary flow and the U-bend primary temperatures within steam generator tubes 12.

When an orifice insert is placed in a steam generator tube 12, the flow through the tube 12 is reduced due to the greater hydraulic resistance. If orifice inserts are placed in a small number of steam generator tubes (for example, Row 1), the pressure drop from the tube inlets to the tube outlets does not significantly change. The velocity V of the flow through the tubes having orifice inserts can be calculated as:

$$V = \sqrt{\frac{2g\Delta P}{\rho(K + K_o + fL/d)}}, \quad (1)$$

wherein g=the gravitational constant,
P=the pressure drop,
$\rho$=the flow density,
K=the hydraulic resistance without an orifice insert,
$K_o$=the hydraulic resistance with an orifice insert,
f=the friction factor,
L=the total tube length, and
d=the tube inner diameter, and where K can be calculated from available data such as that found in I.E. Idel'chick, "Handbook of Hydraulic Resistance," AECTR 6630 (1060) or Crane, "Flow at Fluids through Valves, Fittings and Pipe," Crane Company Technical Paper No. 410 (1969).

The mass flow $\dot{m}$ in the tubes having orifice. inserts is:

$$\dot{m}_o = \rho V A \quad (2)$$

where $$A = \pi d^2/4$$

Using this mass flow rate, the temperature distribution along the length of the tubes is:

$$\frac{T_x - T_s}{T_h - T_s} = e - \left(\frac{U\pi DX}{\dot{m}C_p}\right), \quad (3)$$

where $T_x$=the temperature at a given distance from the tube outlet,
$T_s$=the saturation temperture of the secondary side,
$T_h$=the temperature at the tube inlet,
U=the overall heat transfer coefficient for a tube
D=the tube outside diameter
X=the distance from the tube inlet
m=the mass flow rate inside the tube, and
$C_p$=the specific heat.

The temperature at the U-bend can be determined by substituting the following into equation (3):

$$X = L/2$$

$$\dot{m} = \dot{m}_o$$

The mass flow in a tube without an orifice insert can be determined using equations (1) and (2) and setting $K_o$=0. The reduction in temperature is calculated by subtracting the values calculated from equation (3) using flow with and without an orifice insert.

Referring now to FIGS. 3*a* and 3*b*, there is shown a first embodiment of the invention, in which orifice insert 34 includes a simple orifice 42. Orifice 42 comprises lower and upper cylindrical portions 44 and 46, which are coaxial with longitudinal axis A of sleeve 38. Lower cylindrical portion 44 includes a bottom end 44*a* opening into bottom end 38*a* of sleeve 38 and a top end 44*b*. Upper cylindrical portion 46 includes a bottom end 46*a*, which opens into top end 44*b* of lower cylindrical portion 44, and a top end 46*b* which opens into top end 38*b* of sleeve 38. The diameter of upper cylindrical portion 46 is smaller than the diameter of lower cylindrical portion 44.

Referring now to FIGS. 4*a* and 4*b*, there is shown a second embodiment of the invention, in which an orifice insert 34' includes a multiple orifice 48. Multiple orifice 48 comprises a lower cylindrical portion 50, a first intermediate cylindrical portion 52, a second intermediate cylindrical portion 54, a third intermediate cylindrical portion 56, a fourth intermediate cylindrical portion 58, and an upper cylindrical portion 60. Lower cylindrical portion 50, intermediate cylindrical portions 52, 54, 56, and 58, and upper cylindrical portion 60 each have respective bottom ends 50*a*, 52*a*, 54*a*, 56*a*, 58*a*, and 60*a* and respective top ends 50*b*, 52*b*, 54*b*, 56*b*, 58*b*, and 60*b*. Bottom end 50*a* of lower cylindrical portion 50 opens into bottom end 38*a* of sleeve 38; bottom end 52*a* of first intermediate cylindrical portion 52 opens into top end 50*b* of lower cylindrical portion 50; bottom end 54*a* of second intermediate cylindrical portion 54 opens into top end 52*b* of first intermediate cylindrical portion 52; bottom end 56*a* of third intermediate cylindrical portion 56 opens into top end 54*b* of second intermediate cylindrical portion 54; bottom end 58*a* of fourth intermediate cylindrical portion 58 opens into top end 56*b* of third intermediate cylindrical portion 56; bottom end 60*a* of upper cylindrical portion 60 opens into top end 58*b* of fourth intermediate cylindrical portion 58; and top end 60*b* of upper cylindrical portion 60 opens into top end 38*b* of sleeve 38. The diameter of upper cylindrical portion 60 is smaller than the diameter of lower cylindrical portion 50, and the diameters of first and third intermediate cylindrical portions 52 and 56 are equal to the diameter of upper cylindrical portion 60, while the diameters of second and fourth intermediate cylindrical portions 54 and 58 are equal to the diameter of lower cylindrical portion 50. Lower cylindrical portion 50, intermediate cylindrical portions 52, 54, 56, and 58, and upper cylindrical portion 60 are all coaxial with longitudinal axis A of sleeve 38.

Referring now to FIGS. 5*a*–5*c* there is shown a third embodiment of the invention in which orifice insert 34" includes a staggered multiple orifice 62. Staggered multiple orifice 62 comprises a lower cylindrical portion 64, a first intermediate cylindrical portion 66, a second intermediate cylindrical portion 68, a third intermediate cylindrical portion 70, a fourth intermediate cylindrical portion 72, and an upper cylindrical portion 74. Lower cylindrical portion 64, intermediate cylindrical portions 66, 68, 70, and 72, and upper cylindrical portion 74 each have respective bottom ends 64*a*, 66*a*, 68*a*, 70*a*, 72*a*, and 74*a*, and respective top ends 64*b*, 66*b*, 68*b*, 70*b*, 72*b*, and 74*b*. Bottom end 64*a* of lower cylindrical portion 64 opens into bottom end 38*a* of sleeve 38; bottom 66*a* of first intermediate cylindrical portion 66 opens into top end 64*b* of lower cylindrical portion 64; bottom end 68*a* of second intermediate cylindrical portion 68 opens into top end 66*b* of first intermediate cylindrical portion 66; bottom end 70*a* of third intermediate cylindrical portion 70 opens into top end 68*b* of second intermediate cylindrical portion 68; bottom end 72*a* of fourth intermediate cylindrical portion 72 opens into top end 70*b* of third intermediate cylindrical portion 70; bottom end 74*a* of upper cylindrical portion 74 opens into top end 72*b* of fourth intermediate cylindrical portion 72; and top end 74*b* of upper cylindrical portion 74 opens into top end 38*b* of sleeve 38. The diameter of upper cylindrical portion 74 is smaller than the diameter of lower cylindrical portion 64, and the diameters of first and third intermediate cylindrical portions 66 and 70 are equal to the diameter of upper cylindrical portion 74, while the diameters of second and fourth intermediate cylindrical portions 68 and 72 are equal to the diameter of lower cylindrical portion 64. Lower cylindrical portion 64, and second and fourth intermediate cylindrical portions 68 and 72 are coaxial with longitudinal axis A of sleeve 38. The axes of first and third intermediate cylindrical portions 66 and 70 are disposed at diametrically opposed locations with respect to lower cylindrical portion 64, and upper cylindrical portion 74 is coaxial with first intermediate cylindrical portion 66.

Figure 6A:
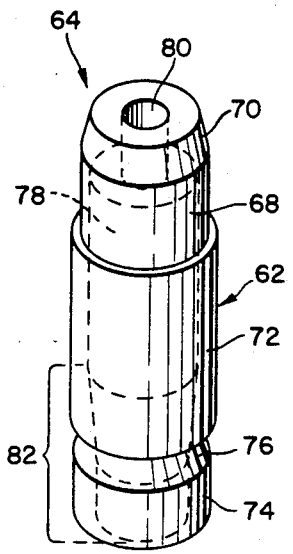
FIG. 6*a* is a perspective view of a fourth embodiment of an orifice insert according to the invention.
Figure 6B:
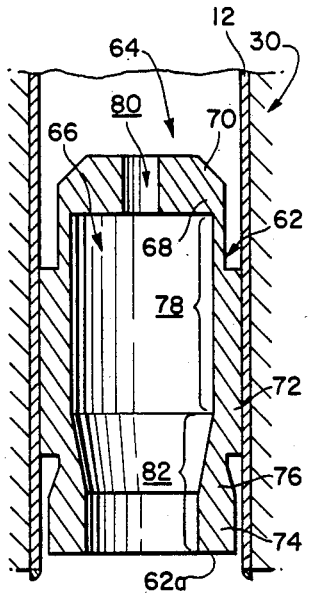
FIG. 6*b* is a cross-sectional view of the orifice insert shown in FIG. 6*a*, taken along line 6*b*—6*b*, installed in a steam generator tube.

Referring now to FIGS. 6*a* and 6*b* there is illustrated an orifice insert 62 which has been modified for affixation in tubes 12 by mechanical expansion. Orifice insert 62 comprises a sleeve 64. A simple orifice 66 extends the entire length of sleeve 64.

Sleeve 64 has a bottom end 64*a* and a top end 64*b*, and comprises an upper cylindrical portion 68 having a bevelled top 70, an intermediate cylindrical portion 72, and a lower cylindrical portion 74 having a bevelled top 76. Top end 64*b* is inserted into a tube 12 so that bottom end 64*a* is substantially flush with the opening of the tube 12. The outer diameter of intermediate cylindrical portion 72 is substantially the same as the inner diameter of steam generator tubes 12, the outer diameter of lower cylindrical portion 74 is smaller than the outer diameter of intermediate cylindrical portion 72, and the outer diameter of upper cylindrical portion 68 is smaller than the outer diameter of lower cylindrical portion 74.

Simple orifice 66 comprises lower and upper cylindrical portions 78 and 80, similar to lower and upper cylindrical portions 44 and 46 of simple orifice 42 shown in FIGS. 3*a* and 3*b*, except that uper cylindrical portion 80 of orifice 66 is shorter than upper cylindrical portion 46 of orifice 42. Simple orifice 66 further comprises a necked-in portion 82 interposed between the bottom of lower cylindrical portion 78 and bottom end 64*a* of sleeve 64. The diameter of necked-in portion 82 at all points along its length is smaller that the diameter of lower cylindrical portion 78.

Necked-in portion 82 of simple orifice 66 extends lengthwise above bevelled top 76 of lower cylindrical portion 74 of sleeve 64. Lower cylindrical portion 74, including bevelled top 76, and necked-in portion 82 are adapted for outward expansion upon application of an expansion tool (not shown) to necked-in portion 82, whereby lower cylindrical portion 74 is held in mating engagement with the inside of tube 12 along a portion of its length.

Figure 7A:
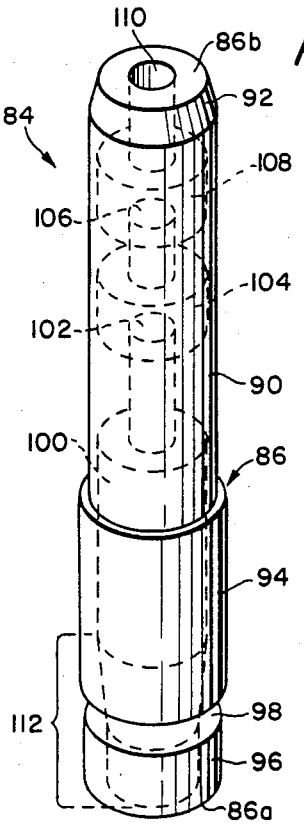
FIG. 7*a* is a perspective view of a fifth embodiment of an orifice insert according to the invention.
Figure 7B:
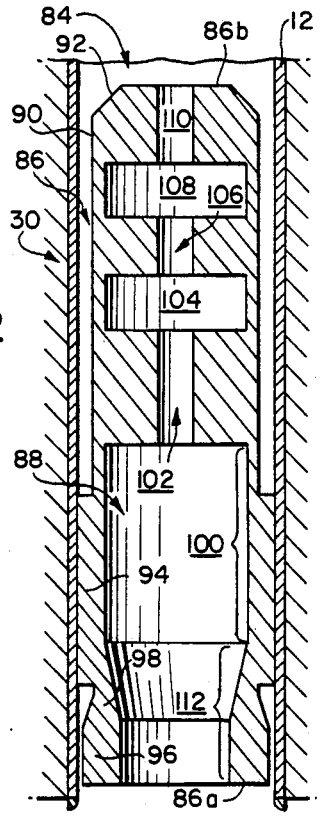
FIG. 7*b* is a cross-sectional view of the orifice insert shown in FIG. 7*a*, taken along line 7*b*—7*b*, installed in a steam generator tube.
Figure 8A:
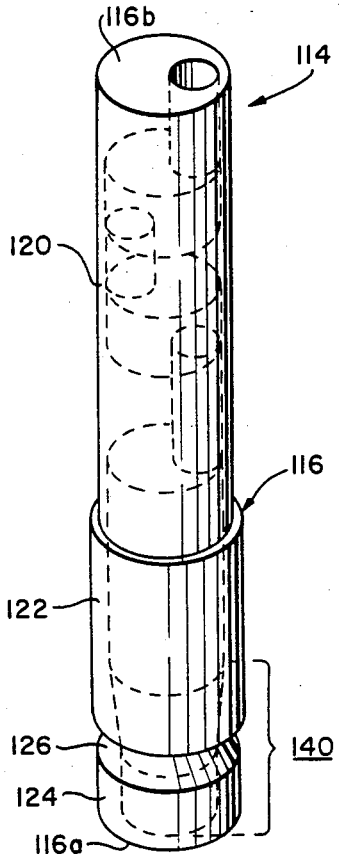
FIG. 8*a* is a perspective view of a sixth embodiment of an orifice insert according to the invention.
Figure 8B:
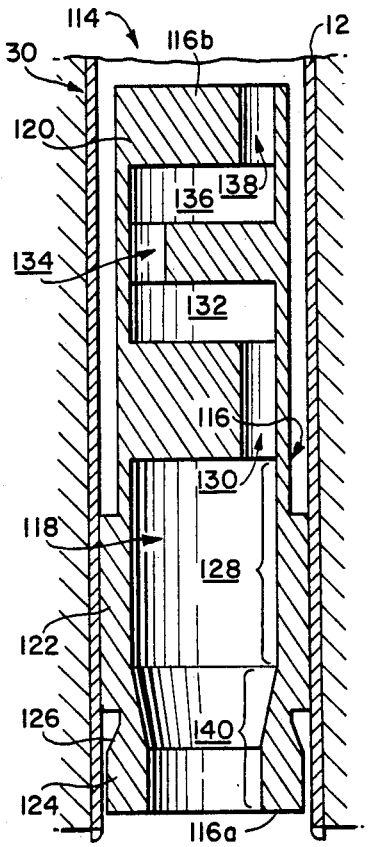
FIG. 8*b* is a cross-sectional view of the orifice insert shown in FIG. 8*a*, taken along line 8*b*—8*b*, installed in a steam generator tube.

Referring now to FIGS. 7*a* and 7*b* there is illustrated another orifice insert 84 which has been modified for affixation in tubes 12 by mechancial expansion. Orifice insert 84 comprises a sleeve 86. A multiple orifice 88 extends the entire length of sleeve 86.

Sleeve 86 has a bottom end 86*a* and a top end 86*b*, and comprises an upper cylindrical portion 90 having a bevelled top 92, an intermediate cylindrical portion 94, and a lower cylindrical portion 96 having a bevelled top 98. Sleeve 86 is thus similar in configuration to sleeve 64 shown in FIGS. 6*a* and 6*b*, except that upper cylindrical portion 90 of sleeve 86 is longer than upper cylindrical portion 68 of sleeve 64, in order to accommodate multiple orifice 88.

Top end 86*b* of sleeve 86 is inserted into a tube 12 so that bottom end 86*a* is located in the vicinity of the opening of the tube 12. The outer diameter of intermediate cylindrical portion 94 is substantially the same as the inner diameter of steam generator tubes 12, the outer diameter of lower cylindrical portion 96 is smaller than the outer diameter of intermediate cylindrical portion 94, and the outer diameter of upper cylindrical portion 90 is smaller than the outer diameter of lower cylindrical portion 96.

Multiple orifice 88 comprises a lower cylindrical portion 100, a first intermediate cylindrical portion 102, a second intermediate cylindrical portion 104, a third intermediate cylindrical portion 106, a fourth intermediate cylindrical portion 108, and an upper cylindrical portion 110, similar respectively to lower cylindrical portion 50, first intermediate cylindrical portion 52, second intermediate cylindrical portion 54, third intermediate cylindrical portion 56, fourth intermediate cylindrical portion 58, and upper cylindrical portion 60 of orifice insert 34 shown in FIGS. 4*a* and 4*b*. Multiple orifice 88 further comprises a necked-in portion 112 interposed between the bottom of lower cylindrical portion 100 and bottom end 86*a* of sleeve 86. The diameter of necked-in portion 112 at all points along its length is smaller than the diameter of lower cylindrical portion 100.

Necked-in portion 112 of muliple orifice 88 extends lengthwise above belleved top 98 of lower clylindrical portion 96 of sleeve 86, in the same manner so bevelled top 76 of lower cylindrical portion 74 of sleeve 64 shown in FIGS. *6a* and *6b*. Lower cylindrical portion 96, including bevelled top 98, and necked-in portion 112, are also adapted for outward expansion upon application of an expansion tool (not shown) to necked-in portion 112.

Referring now to FIGS. *8a* and *8b* there is illustrated a third orifice insert 114 which has been modified for affixation in tubes 12 by mechanical expansion. Orifice insert 114 comprises a sleeve 116. A staggered multiple orifice 118 extends the entire length of sleeve 116.

Sleeve 116 has a bottom end 116*a* and a top end 116*b*, and comprises a upper cylindrical portion 120, an intermediate cylindrical portion 122, and a lower cylindrical portion 124 having a bevelled top 126. Sleeve 116 is similar in configuration and dimensions to sleeve 86 shown in FIGS. *7a* and *7b*, except that upper cylindrical portion 120 does not have a bevelled top.

Top end 116*b* of sleeve 116 is inserted into a tube 12 so that bottom end 116*a* is substantially flush with the opening of the tube 12. The outer diameter of intermediate cylindrical portion 122 is substantially the same as the inner diameter of steam generator tubes 12, the outer diameter of lower cylindrical portion 124 is smaller than the outer diameter of intermediate cylindrical portion 122, and the outer diameter of upper cylindrical portion 120 is smaller than the outer diameter of lower cylindrical portion 124.

Staggered multiple orifice 118 comprises a lower cylindrical portion 128, a first intermediate cylindrical portion 130, a second intermediate cylindrical portion 132, a third intermediate cylindrical portion 134, a fourth intermediate cylindrical portion 136, and an upper cylindrical portion 138, similar respectively to lower cylindrical portion 64, first intermediate cylindrical portion 66, second intermediate cylindrical portion 68, third intermediate cylindrical portion 70, fourth intermediate cylindrical portion 72, and upper cylindrical portion 74 of orifice insert 34 shown in FIGS. *5a–5c*. Staggered multiple orifice 118 further comprises a necked-in portion 140 interposed between the bottom of lower cylindrical portion 128 and bottom end 116*a* of sleeve 116. The diameter of necked-in portion 140 at all points along its length is smaller than the diameter of lower cylindrical portion 128.

Necked-in portion 140 of staggered multiple orifice 118 extends lengthwise above bevelled top 126 of lower cylindrical portion 124 of sleeve 116, in the same manner as bevelled top 76 of lower cylindrical portion 74 of sleeve 64 shown in FIGS. *6a* and *6b*. Lower cylindrical portion 124, including bevelled top 126, and necked-in portion 140 are also adapted for outward expansion upon application of an expansion tool (not shown) to necked-in portion 140.

Preferably, orifice inserts 34, 34', 64, and 84, which have simple or multiple orifices are bored from a single piece of material using a variable bet. Orifice inserts 34'' and 114, which have staggered multiple orifices, cannot be bored from a single piece of material. Each portion of the staggered multiple orifice is bored separately in its own plate, as shown in FIG. *5a*, and the individual plates are then assembled and welded together, as shown in FIG. *5b*.

Thus, it will be seen that all embodiments of the present invention provide a unique method of controlling corrosion in steam generator tubes without the need for plugging. Moveover, the present invention is easy to install, so as to render use of all embodiments convenient to users. While preferred embodiments of the invention have been disclosed, it should be understood that the spirit and scope of the invention are to be limited solely by the appended claims, since numerous modifications of the disclosed embodiments will undoubtedly occur to those of skill in the art.

We claim as our invention:

1. In a nuclear steam generator having an array of U-shaped steam generator tubes, each of said tubes carrying a flow of water therethrough for the transfer of heat therefrom to water to be heated surrounding said steam generator tubes, an orifice insert for placement in an inlet opening of said steam generator tubes, said orifice insert comprising:

a sleeve having an outlet end, and inlet end located in use in the vicinity of the inlet opening of the steam generator tube, and a longitudinal axis, at least a portion of the outer diameter of said sleeve being substantially the same as the inner diameter of the steam generator tube, and an orifice disposed in and extending the entire length of said sleeve for directing said flow of water from said inlet end to said outlet end of said sleeve, said orifice comprising:

a first cylindrical orifice portion having an inlet end and an outlet end, said inlet end being in fluid communication with said inlet and of said sleeve; and a second cylindrical orifice portion adjacent said first cylindrical orifice portion and having an inlet end and an outlet end; wherein the diameter of said second cylindrical orifice portion is smaller than the diameter of sald first cylindrical orifice portion to present a transition to said fluid flow, whereby the pressure and thus the temperature of said flow of water past said transition conside ring the direction of said flow, is reduced and the corrosive attack of said flow of water on the interior surface of the steam generator tubes is likewise reduced.

2. In a nuclear steam generator having an array of U-shaped steam generator tubes to receive heated water therethrough for the transfer of heat therefrom to water to be heated surrounding said steam generator tubes, an orifice insert for placement in an inlet opening of said steam generator tubes, said orifice insert comprising:

a sleeve having an outlet end, an inlet end located in use in the vicinity of the inlet opening of the steam generator tube, and a longitudinal axis, at least a portion of the outer diameter of said sleeve being substantially the same as the inner diameter of the steam generator tube, and an orifice disposed in and extending the entire length of said sleeve for directing a flow of heated water from said inlet to said outlet end of said sleeve, said orifice comprising a first portion disposed in communication with said inlet end and having a first cross-sectional area, and a second portion disposed adjacent said first portion and having a second cross-sectional area less than said first cross-sectional area to present a transition to said heated water, whereby the pressure and thus the temperature of said heated water within said second portion is reduced and the corrosive attack of said heated water on the interior surface of the steam generator tubes is likewise reduced.

3. The orifice insert of claim 2, wherein:

said first portion is circular and has an inlet end and an outlet end, said inlet end being in fluid communication with said inlet end of said sleeve, and said second portion is circular and has an inlet end and an outlet end, said outlet end opening into said outlet end of said sleeve and said inlet end being in fluid communication with said outlet end of said first portion, wherein the diameter of said second portion is smaller than the diameter of said first portion, and said first portion is coaxial with said longitudinal axis.

4. The orifice insert of claim 1, wherein said sleeve is cylindrical and the outer diameter of said sleeve along substantially its entire length is substantially the same as the inner diameter of the steam generator tube.

5. The orifice insert of claim 3, wherein said sleeve is cylindrical and the outer diameter of said sleeve along substantially its entire length is substantially the same as the inner diameter of the steam generator tube.

* * * * *